US010058871B2

(12) United States Patent
Pankratz et al.

(10) Patent No.: US 10,058,871 B2
(45) Date of Patent: Aug. 28, 2018

(54) BALL MILL HAVING SPATIAL UNBALANCE COMPENSATION

(71) Applicant: RETSCH GMBH, Haan (DE)

(72) Inventors: Jürgen Pankratz, Haan (DE); Stefan Mähler, Velbert (DE); Matthias Niewind, Wülfrath (DE); Frank Janetta, Bottrop (DE)

(73) Assignee: RETSCH GMBH, Haan (DE)

( * ) Notice: Subject to any disclaimer, the term of this patent is extended or adjusted under 35 U.S.C. 154(b) by 892 days.

(21) Appl. No.: 14/406,582

(22) PCT Filed: Jun. 14, 2013

(86) PCT No.: PCT/EP2013/062402
§ 371 (c)(1),
(2) Date: Dec. 9, 2014

(87) PCT Pub. No.: WO2013/186372
PCT Pub. Date: Dec. 19, 2013

(65) Prior Publication Data

US 2015/0129692 A1 May 14, 2015

(30) Foreign Application Priority Data

Jun. 15, 2012 (DE) ..... 10 2012 105 217

(51) Int. Cl.

| | |
|---|---|
| ***B02C 17/08*** | (2006.01) |
| ***B02C 17/14*** | (2006.01) |
| ***B02C 17/24*** | (2006.01) |
| ***B02C 17/18*** | (2006.01) |

(52) U.S. Cl.
CPC ..... *B02C 17/08* (2013.01); *B02C 17/14* (2013.01); *B02C 17/1815* (2013.01); *B02C 17/24* (2013.01)

(58) Field of Classification Search
CPC ..... B02C 17/14; B02C 17/24; B02C 17/1815; B02C 17/08
USPC ..... 241/46.15, DIG. 27, 65, 175, 176; 1/46.15
See application file for complete search history.

(56) References Cited

U.S. PATENT DOCUMENTS 459,662 A * 9/1891 Steinhoff ..... F24C 13/00 126/5
1,831,049 A * 11/1931 Treschow ..... B02C 17/18 165/90

(Continued)

FOREIGN PATENT DOCUMENTS

DE 19712905 C2 11/2003
WO WO 2009/026990 3/2009

OTHER PUBLICATIONS

International Search Report for International Application No. PCT/EP2013/062402, dated Oct. 2, 2013.

*Primary Examiner* — Faye Francis
*Assistant Examiner* — Smith O Bapthelus
(74) *Attorney, Agent, or Firm* — Jason H. Vick; Sheridan Ross, PC

(57) ABSTRACT

A ball mill is provided comprising at least two milling cup retainers arranged on a machine base plate, each milling cup retainer being designed for a milling cup clamped in the milling cup retainer in a lying position, each milling cup having end-face milling cup ends and a filling of balls as milling bodies and comprising a drive that causes an out-of-phase rotational motion between the milling cup retainers.

15 Claims, 3 Drawing Sheets

(56) References Cited

U.S. PATENT DOCUMENTS

Figure 1:
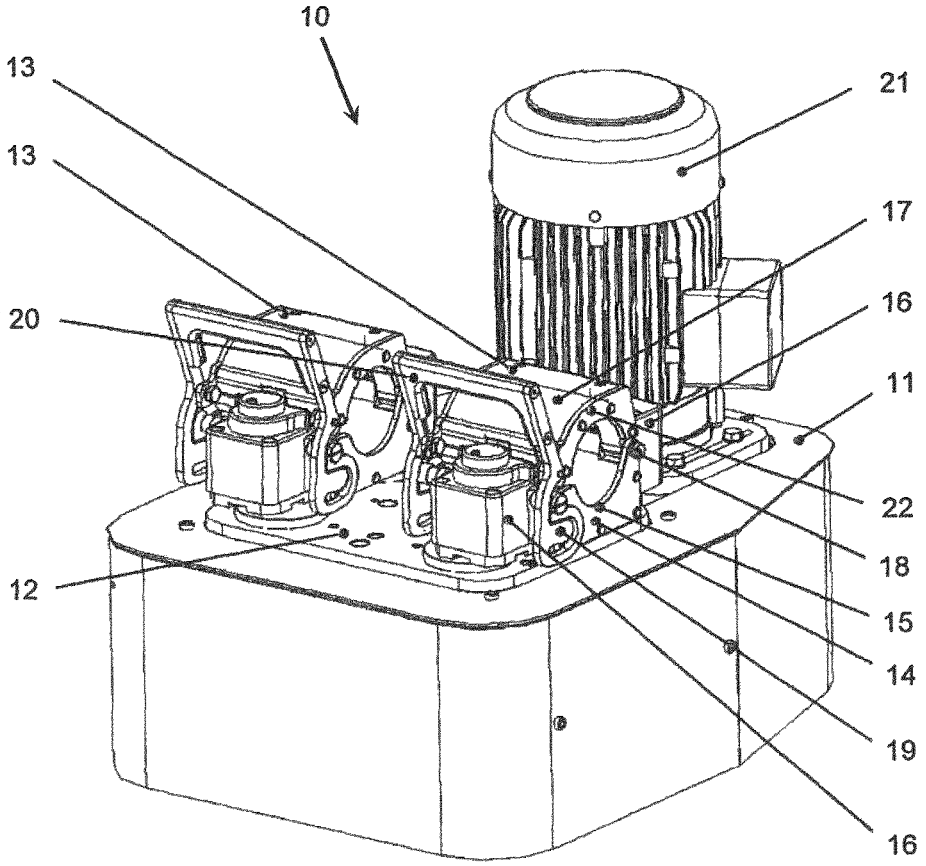

| | | | | | |
|---|---|---|---|---|---|
| 1,951,823 | A * | 3/1934 | Eppers | B02C 17/08 | 241/135 |
| 2,729,110 | A * | 1/1956 | Killian | F16H 55/171 | 474/153 |
| 2,937,814 | A * | 5/1960 | Joisel | B02C 17/08 | 241/137 |
| 3,286,939 | A * | 11/1966 | Karpenko | B02C 17/14 | 241/175 |
| 6,086,242 | A * | 7/2000 | Rajamani | B02C 17/08 | 241/171 |
| 6,126,097 | A * | 10/2000 | Chen | B02C 17/08 | 241/170 |
| 6,334,583 | B1 * | 1/2002 | Li | B02C 17/08 | 241/175 |
| 7,744,027 | B2 * | 6/2010 | Nagao | B02C 17/08 | 241/170 |
| 8,042,754 | B2 * | 10/2011 | Mahler | B02C 17/14 | 241/175 |
| 8,162,246 | B2 * | 4/2012 | Long | B02C 2/047 | 241/101.2 |
| 2010/0181402 | A1 | 7/2010 | Mahler et al. | | |

* cited by examiner

BALL MILL HAVING SPATIAL UNBALANCE COMPENSATION

CROSS REFERENCE TO RELATED APPLICATIONS

This application is a national stage application under 35 U.S.C. 371 of PCT Application No. PCT/EP2012/062402 having an international filing date of 14 Jun. 2013, which designated the United States, which PCT application claimed the benefit of German Application No. 10 2012 105 217.4 filed 15 Jun. 2012, each of which are incorporated herein by reference in their entirety.

The invention relates to a ball mill comprising at least two milling cup retainers arranged on a machine base plate, with each milling cup retainer being designed for a milling cup clamped in the milling cup retainer in a lying position, each milling cup having end-face milling cup ends and a filling of balls as milling bodies and comprises a drive which causes a rotational motion of the milling cup retainers.

A ball mill with the above mentioned features is known from WO 2009/026990 A1. In said ball mill, as opposed to frequently used conventional planetary ball mills such as described in DE 197 12 905 C2 the movement paths of the balls inside the milling cup owing to the arrangement of the milling cup being aligned to the longitudinal axis flat or at an angle of 60 degrees in a lying position inside the milling cup changes in such a manner, that the end-face milling cup ends are involved in the crushing process as stop and grinding area. In this process, on the one hand, a periodic force motion component acts on the balls in direction of the side walls of the milling cup during the milling process caused by the rotation of the milling cup, while on the other hand, owing to the arrangement of the milling cup in a lying position, another additional force motion component is acting on the balls in the direction of the ends of the milling cup. Thus, it is achieved that when the balls move at the side walls of the milling cup the milling material to be ground is subjected mainly to friction and when the balls hit the milling cup ends the same are exposed to impact force. At the same time the milling material is thoroughly mixed owing to the movements of the balls in longitudinal direction of the milling chamber, exposing all particles of the milling material at the same time, thus improving the grinding efficiency. The severity of the friction- and impact components can be adjusted by setting or selecting the length and diameter of the milling cup in relation to the swing diameter and the diameter of the balls as well as the specific ball mass.

Insofar as both the milling cup retainers with their milling cups arranged inside in a lying position are mounted on a common machine base plate, it is proposed to use a spring-mass-valve as drive, by means of which the machine base plate is set into rotary motion causing the two milling cup retainers to move on said circular path. In case of said conventional ball mill this was found to be disadvantageous since the rotary motion caused by the spring-mass-valve was too uncertain for the movement paths of the balls taking place inside each milling cup.

Thus object of the invention is to improve a ball mill having the above mentioned design in a manner, in which the milling cups are put in a restraint-guided motion in order to achieve a precisely repetitive movement pattern of the balls.

According to the invention said problem is solved by the independent claims. Preferred embodiments are object of the related claims.

The invention is based on the general concept that each of the milling cup retainers, being arranged in pairs, is put into restraint-guided circular motion, oriented parallel to the plane of the machine base plate by means of a drive via two eccentric shafts connected to the milling cup retainers on faces opposite to each other in relation to an axis of symmetry of the milling cup, wherein on each of the eccentric shafts being put through the machine base plate and being assigned to one milling cup retainer each, a counter weight is arranged as mass equalizer for the milling cup retainer holding the milling cup clamped inside and which is connected to the eccentric shaft in relation to the longitudinal axis of the two eccentric shafts connected to the milling cup retainers and wherein the eccentricities for the two milling cup retainers of the eccentric shafts connected to the same are equal and the counterweights thereof are arranged on faces opposite each other in relation to the longitudinal axis of the milling cups and the milling cup retainers are put into a counter rotating, out-of-phase circular motion.

Thus it is possible to set a movement pattern in which the milling cups move on small circular paths, with the ratio of the diameter of the circular path on the one hand and the length of the milling cup being adjusted such, that by the impact of the milling material and the grinding balls hitting the milling cup ends a substantial part of the milling work takes place in the milling cup at the milling cup ends. But using eccentric shafts gives rise to the problem that during operation of the ball mill substantial unbalance forces and unbalance moments develop which have to be compensated. The problem of compensating unbalance forces being caused in the movement plane of the milling cup retainer is solved by providing an arrangement comprising of two milling cup retainers which are driven in a counter rotating and out-of-phase manner, which in this case is not sufficient since the drive of the eccentric shaft also causes unbalance moments because the milling cup retainers with their clamped milling cups which are connected to the upper ends of the eccentric shafts give rise to corresponding torques around an axis perpendicular to the plane, in which the milling cup retainers move, in the center between the milling cup retainers. Said torques change their operating direction in the same frequency in which the milling cups rotate, causing torsional vibration which, according to the invention, is compensated by an additional mass equalizer on each of the eccentric shafts in the zone below the milling cup retainer. For this purpose one counterweight each is arranged on the eccentric shaft which is installed at the face opposite the connection of the milling cup retainer on the upper end of the assigned eccentric shaft in relation to the longitudinal axis of the eccentric shaft. Additional unbalance moments result from the fact, that the centrifugal force acting on the milling cup retainer arranged at one end of the eccentric shaft and the centrifugal force acting on the counter weight arranged on the other end of the eccentric shaft cause a torque around axes extending in horizontal direction. Said unbalance moments rotate together with the rotation of the milling cups and counterweights around the vertical axis on the plane in which the milling cups move.

According to the invention the spatial unbalance problem of having to compensate unbalance forces and unbalance moments simultaneously is solved in that not only the unbalance forces caused by a rotating milling cup retainer are compensated by installing an additional second milling cup retainer driven in a counter-rotating and out-of-phase manner but moreover by providing counter weights on the eccentric shafts putting the milling cup retainers into rotation in a manner, in which the unbalance moments, being caused in the plane of the milling cup retainers after compensation of the unbalance forces, are also compensated.

In the context of the present invention the "lying" arrangement of the milling cups is defined in the same manner as in the generic WO 2009/ 026990 A1, namely as a flat or slanting arrangement being placed at an angle of 60 degrees.

The invention comprising an arrangement of two milling cups can also be realized in a design having multiples of two milling cups, for instance with four or six milling cups.

When, according to the invention, each of the milling cup retainers is connected to two eccentric shafts being arranged on faces of the milling cup retainer opposite to each other in relation to a symmetrical axis, in an alternative embodiment of the invention it can be provided, that each of the milling cup retainers is connected to an eccentric shaft on faces opposite to each other in relation to the longitudinal axis of the milling cup or that alternatively, each of the milling cup retainers is connected to one eccentric shaft each in the area of the end faces of the milling cup.

According to one embodiment of the invention it can be provided for each of the milling cup retainers to comprise a lower part receiving the milling cup in a lying or slanting position and which is connected to the two eccentric shafts on faces opposite to each other in relation to an axis of symmetry of the milling cup and an upper part linked to the lower part and overlapping the milling cup on top which can be clamped to the lower part.

Moreover, with ball mills the energy input required for the crushing process is of importance in so far as it is not supposed to cause inadmissible heating of the milling material. For instance, it is possible, that during heating of the milling material to be crushed, the glass transition temperature or softening temperature of plastic material is exceeded, causing sticking or clogging of the milling chamber. Thus, if cooling of the milling chamber or the milling cup is desired, the drive of the two milling cups via their assigned eccentric shafts according to the invention offers a good option for providing adequate cooling of the milling cups. Thus, according to a detailed embodiment of the invention, in order to cool the milling cup during the milling process it is provided for the two eccentric shafts connected to a milling cup retainer to have a hollow shaft body, through which a cooling medium can be conducted and that the milling cup retainer in which the milling cup is clamped is connected to the two eccentric shafts in a leak proof manner and designed having hollow spaces and that the one eccentric shaft assigned to the milling cup retainer is connected to a cooling medium inlet and the other eccentric shaft assigned to the milling cup retainer is connected to a cooling medium outlet.

Moreover it can also be provided for the lower part of the milling cup retainer to be provided hollow spaces in its connecting areas surrounding the ends of the two eccentric shafts as well as in a middle area forming a support for the clamped milling cup, in order to conduct a cooling medium through the same. Furthermore it can be provided that the upper part of milling cup retainer overlapping the milling cup comprises at least one hollow space in the middle part supported by the milling cup being connected to the hollow spaces of the connection areas for the cooling medium to be passed through.

The above described cooling of a milling cup or a milling cup retainer respectively by means of a cooling medium being passed through the eccentric shafts can be employed for all types of mills using eccentric shafts as drive or for which eccentric shafts can be used as drive. In this respect the use of the above explained principle of the invention is not restricted to ball mills having milling cups which are arranged in a lying position but can also be applied to all mills being operated by an eccentric shaft drive system.

Moreover, it can be provided that the milling cup ends of milling cups clamped in a lying or slanting position can be designed as flat, for example resulting in a cylindrical milling cup design in milling cups having a circular cross section, Alternatively, it can be provided for the end-facing milling cup ends to be dome shaped.

Insofar as it is object of the invention, to dimension the masses of milling cups and retainers on the one hand and eccentric shafts with the attached counterweights on the other hand in such a manner, that filling the milling cup with milling material and if required, with balls, does not affect the unbalance compensation of the ball mill, it can also be provided in one embodiment of the invention for the counterweights which are arranged on the eccentric shaft below the milling cup retainer to be readjusted according to the mass of the retainer and the therein clamped milling cup. In the simplest scenario, readjustment can be done by attaching additional weights. Another option is radial displacement of the centers of gravity of the eccentrically mounted counter weights.

In the context of the invention, it makes sense to use oblong milling cups, in which the length specified for the longitudinal side and thus the space between the milling cup ends is greater than the diameter of the section extending between the milling cup ends. In this context it is practical to have differently shaped milling cups when realizing the invention. Thus, it can be provided for the respective milling cups to have a circular cross section or an elliptical cross-section or a rectangular cross-section with rounded corner areas, wherein in the last-mentioned embodiment the rounded corner areas of the respective milling cup when using grinding bodies inside the milling cup can have a radius corresponding the radius of the milling bodies. Differently shaped milling cups are also possible, for instance milling cups having an elliptical longitudinal section.

Within the scope of the invention it can be provided for the eccentricities of the connections of the milling cup retainers together with the corresponding eccentric shafts to be dimensioned equally, resulting in a circular movement of the milling cup retainers together with the clamped milling cups, with the longitudinal axis of the milling cups clamped in different milling cup retainers remaining during rotation of the same rotation in all positions in a parallel arrangement.

Alternatively, it can be provided for the eccentricities of the connections of the milling cup retainer together with the two respective eccentric shafts to be dimensioned differently, resulting in a rotational movement being initiated in the area of the milling cup retainer of the eccentric shaft having the smaller eccentricity, while on the opposite side of the milling cup retainer the eccentric shaft having the larger eccentricity causes a pendulum movement of the clamped milling cup. In this case only the eccentric shaft having the smaller eccentricity is driven while the other eccentric shaft is steered.

When the two eccentric shafts assigned to a milling cup retainer are firmly attached to their corresponding milling cup retainer with one of their ends and thus are firmly attached to each other, then, because of the manufacturing and assembly tolerances, there is no guarantee that the free lower ends of the eccentric shafts which are to be coupled to a drive medium such as a toothed belt or chain, engage with the common drive medium in a tension-free manner because the system is mechanically over determined. In order to prevent jamming of the eccentric shafts and drive medium one embodiment of the invention provides for both the eccentric shafts assigned to a milling cup retainer to be driven by a common drive medium and to set an equalizing play between the eccentric shaft and the drive medium.

For this purpose it can be provided that a toothed washer each is arranged on the end of the eccentric shaft opposite the milling cup retainer and the drive medium is designed as circulating toothed belt engaging with the tooth of the toothed washer and wherein on one of the two toothed washers the width of the gaps of the toothed washer is larger than the width of the tooth of the belt used. This is in particular the case when all eccentric shafts of a milling cup retainer arranged on a machine base plate are driven by a common tooth belt and in this case the compensating play is set on the toothed washer of one of the two eccentric shafts connected to the same milling cup retainer.

Figure 2:
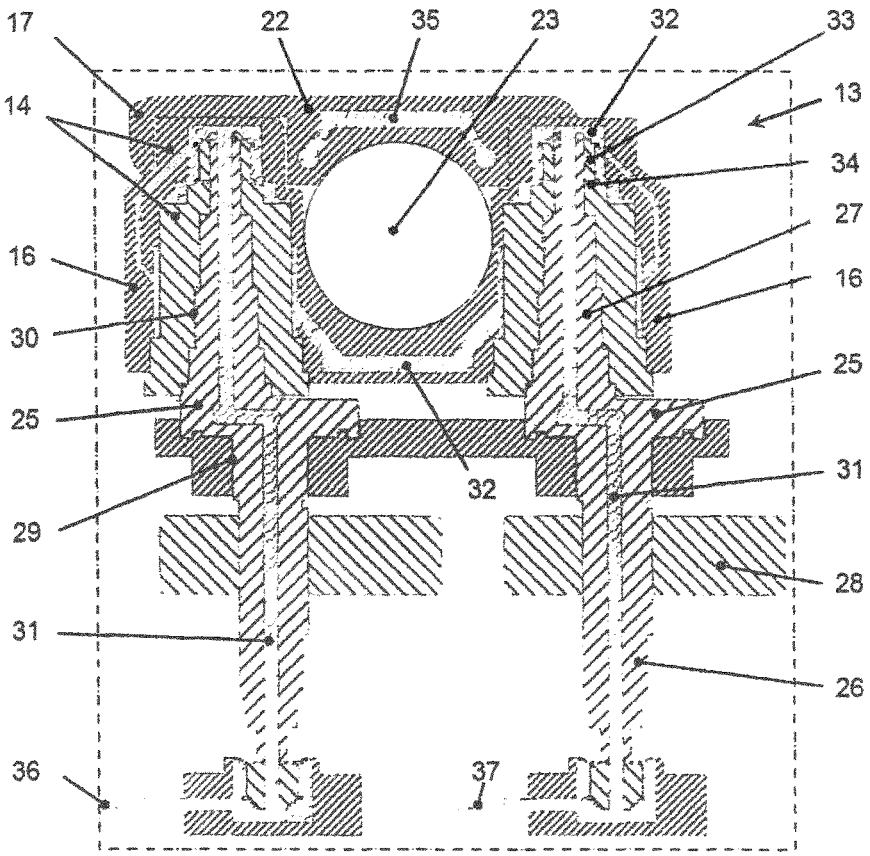
Figures 3A, 3B, 3C:
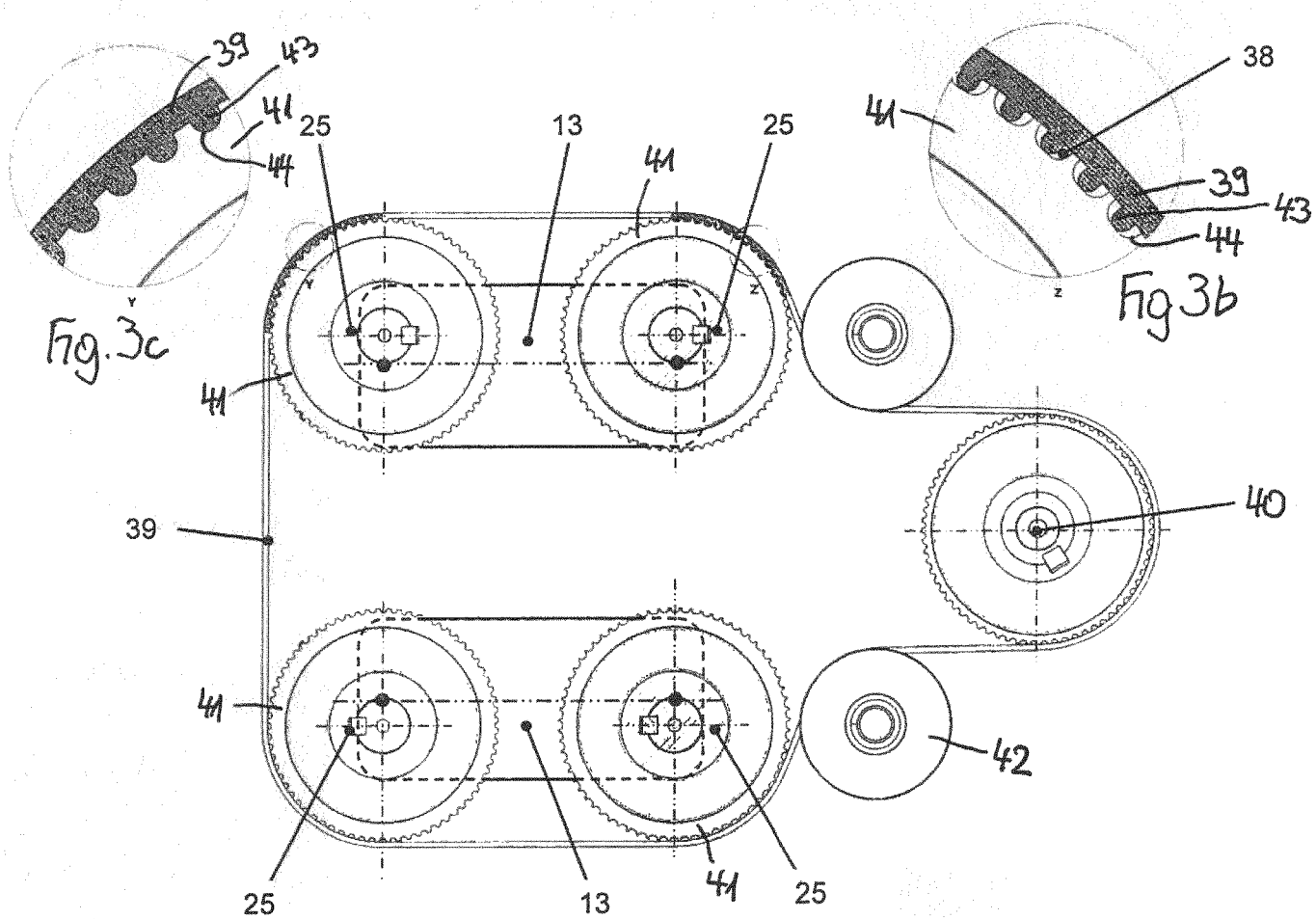

The drawing illustrates an embodiment of the invention described below, wherein show:

FIG. 1 a partial perspective view of a ball mill comprising two milling cup retainers, FIG. 2 a schematic lateral view of a milling cup retainer with a milling cup clamped in the same FIG. 3*a-c* a bottom view of the eccentric shafts assigned to the two milling cup retainers together with the drive medium The ball mill 10 shown in FIG. 1 as a whole comprises a housing 11 (not shown in full) on the upper side of which a machine base plate 12 is arranged for two milling cup retainers 13 to be installed, with one milling cup each clamped in the same. Each of the milling cup retainers 13 comprises a lower part 14 being provided two external connecting areas 16 with a central area 15 serving as bearing surface for a milling cup to be clamped. On one of the connecting areas 16 an upper part 17 overlapping the middle area 15 of the milling cup retainer 13 is swivel mounted around a swivel axis 18, arranged on the connecting area 16, wherein, within the context of the illustrated embodiment, the upper part 17 can be locked with the other connecting area 16 of the lower part 14 on the face opposite of the swivel axis 18 by means of a locking device 19 being operated by a locking lever 20. Alternatively a locking mechanism using a screw joint can also be employed, such as a clamping mechanism using screws and a suitable clamping bracket. The upper part 17 of the milling cup retainer 13 overlaps the middle area 15 of the lower part 14 too, forming a bearing surface for a milling cup retainer with a center section 22, wherein the shape of the middle area 15 of the lower part 14 as well as the center section 22 of the upper part 17 is adapted to the outer contour of the milling cup to be clamped in the milling cup retainer 13.

In the housing 11 a motor 21 is provided, protruding upwardly above the machine base plate 12, which drives the two milling cup retainers 13 arranged on the machine base plate 12 by means of a drive mechanism provided below the machine base plate 12.

As illustrated in FIGS. 1 and 2, two eccentric shafts 25 serve as drive for each of the two milling cup retainers 13, which in each case are connected to the two connecting areas 16 of each of the milling cup retainers 13, thus being joined to the same. Each eccentric shaft 25 comprises a drive section 26 located below the machine base plate 12 and a connecting section 27 projecting over the machine base plate 12 defined in the corresponding connecting area 16 of the milling cup retainer 13. The sections 26 and 27 of each of the eccentric shafts 25 are arranged offset to one another in order to provide the eccentricity, which in the illustrated embodiment is equal. For mounting the drive section 26 of the eccentric shafts 25, bearings 29 are provided below the machine base plate 12, while between the connecting sections 27 of the eccentric shaft 25 and the connecting areas 16 of the respective lower part 14, of each milling cup container 13 connected to the same, bearings 30 are arranged.

Moreover, as illustrated in FIG. 2, a milling cup 23 is placed in the middle area 15 of the corresponding lower part 14 of a milling cup retainer 13 and clamped in the milling cup retainer 13 by means of the upper part 17 spanning the lower part 14 of the milling cup retainer 13.

When the two drive sections 26 of the two eccentric shafts 25 having the same eccentricity are put in rotation by means of the driving mechanism driven by the motor 21, the milling cup 23 being clamped in the milling cup retainer 13 in a lying position moves on a circular path because the two external connecting areas 16, each connected to an eccentric shaft itself are moving on a circular path.

In as far as two milling cup retainers 13 together with their respective milling cups 23 are arranged on the machine base plate 12, the directions of movement of the two milling cups 23 on their respective circular paths are oriented each in opposing directions of movement together with opposing phases of motion in such a manner, that, when the ball mill 10 is in operation, the centrifugal forces acting on the milling cup retainers 13 with their clamped milling cups 23 are compensated above the machine based plate 12.

Since with this arrangement the centrifugal forces compensate each other on the plane, in which the milling cup retainers rotate, but the moments having alternating direction of rotation around a vertical axis remain on this plane, each of the eccentric shafts 25 is provided an additional counterweight 28 in the drive section 26 located below the machine plate 12 with the same being arranged on the face opposite the connecting area 16 of the milling cup retainer 13 located above the machine base plate 12 in relation to the longitudinal axis of the individual eccentric shafts 25. Thus, forces are balanced effectively on each of the eccentric shafts 25 during the circular movement of the milling cup retainer 13 connected to the same, which due to the fact, that two milling cup retainers 13 driven in counter rotation and phase opposition together with the connected eccentric shafts 25 are designed in the same manner, at the same time compensating the above described moment at the vertical axis on which the milling cup retainers 13 rotate as well as moments which are lying in this plane and which are initially caused by the centrifugal forces of the milling cup retainers 13 and the counter weights 28.

In order to provide cooling to the milling cup 23 during operation of the ball mill, the two eccentric shafts 25 are designed having an inner boring 31 as hollow-bored shafts. Accordingly, the two connecting areas 16 facing each other as well as the middle area 15 of the lower part 14 connecting the same are provided hollow spaces 32 which by means of a sealing element 33 fixed at the upper end of each of the eccentric shafts 25 and a sealing surface 34 formed on the milling cup retainers 13 serving as counter sealing element of the sealing element 33 are connected to the borings 31 of the two eccentric shafts 25. In this manner a gaseous or liquid cooling medium introduced into one of the two eccentric shafts 25 can flow via the corresponding eccentric shaft 25 and hollow spaces 32 provided in the lower part 14 to the eccentric shaft 25 connected on the opposite side to the milling cup retainer 13 as well as be discharged from the same. Accordingly, in the illustrated embodiment a cooling medium inlet 36 is provided on the lower end of the left eccentric shaft 25 and a cooling medium outlet 37 is provided on the right eccentric shaft. By designing the middle area 22 of the upper part 17 of each milling cup retainer 13 as having a hollow space 35 and by connecting the same to the hollow spaces 32 of the bottom part 14 it is ensured, that the cooling medium being introduced into the bottom part 14 of the milling cup retainer flows also through the upper part 17 of each retainer. In this manner the milling cup 23 is enclosed by cooled components allowing the temperature inside the milling cup 23 to be restricted during the crushing process.

FIG. 3*a* illustrates the driving concept according to the invention, wherein a revolving toothed belt 39 driven by a toothed lock washer 40 drives all four eccentric shafts 25 assigned to the milling cup retainers 13 as described in FIGS. 1 and 2. For this purpose, the toothed belt 39 wound around the lock washer 40 of the drive is guided over deflection rollers 42 and wound on the outside around the toothed washers 41 arranged on the ends of the eccentric shaft 25, with the teeth 43 of the toothed belt 39 engaging with the tooth gaps 44 of the toothed washers 41. In order to prevent the eccentric shafts 25 and the toothed belt 39 getting jammed during operation of the mill, a compensation play 38 is set on one of the two eccentric shafts 25 between the eccentric shafts 25 and the toothed belt 39. As illustrated in FIG. 3*b*, on one of the two toothed washers 41 the width of the tooth gap 44 is larger than the width of the teeth 45 of the toothed belt 39 resulting in the desired compensation play 38. On the other hand, as illustrated in FIG. 3*c*, the teeth 43 of the toothed belt 39 of the other eccentric shaft assigned to the same milling cup retainer 13 are completely engaged with the tooth gaps 44 of the corresponding toothed washer 41. The same configuration has also been realized for the two eccentric shafts 25 of the other milling cup retainer, which has not been illustrated here.

The features, claims, summary and drawings, disclosed in the above description of the invention can be used individually or in any combination for realizing said invention.

The invention claimed is:

1. A ball mill, comprising:

at least two milling cup retainers arranged on a first side of a machine base plate, wherein each milling cup retainer is configured to clamp a milling cup in a lying or slanting position in a central area of each milling cup retainer, each milling cup having end-face milling cup ends and a filling of balls as milling bodies, and wherein each milling cup retainer is connected to separate eccentric shafts disposed on either side of an axis of symmetry of the central area of each milling cup retainer;

a drive that causes a rotation of the separate eccentric shafts connected to each milling cup retainer and a rotational motion of each of the at least two milling cup retainers in respective guided rotational motions parallel to a plane coincident with the first side of the machine base plate, wherein a first milling cup retainer of the at least two milling cup retainers rotates along a first rotational path in a first phase and a second milling cup retainer of the at least two milling cup retainers rotates along a second rotational path in a second phase, and wherein the first and second phase are out-of-phase with and opposing one another; and a counterweight disposed on each of the separate eccentric shafts connected to each milling cup retainer on a portion of the separate eccentric shafts disposed on a second side of the machine base plate, wherein the second side of the machine base plate is disposed opposite the first side of the machine base plate, and wherein the separate eccentric shafts each pass through the machine base plate from the first side to the second side.

2. The ball mill of claim 1, wherein the at least two milling cup retainers include more than two milling cup retainers having respective separate eccentric shafts, the more than two milling cup retainers arranged in opposing rotational path pairs on the machine base plate.

3. The ball mill of claim 1, wherein each of the milling cup retainers in a pair of milling cup retainers having opposing rotational paths are disposed opposite one another along a longitudinal axis of the milling cup.

4. The ball mill of claim 1, wherein each of the milling cup retainers in the area of the two milling cup ends is connected to one eccentric shaft each.

5. The ball mill of claimed 1, wherein each of the milling cup retainers comprises a lower part configured to hold a milling cup in a flat or slanting position, wherein the lower part is connected to the separate eccentric shafts of a respective milling cup retainer, and wherein each milling cup retainer comprises an upper part hinged to the lower part and overlapping and clamping the milling cup in the central area.

6. The ball mill of claim 1, wherein the separate eccentric shafts each include a hollow shaft body configured to receive and conduct a cooling medium through and in each milling cup retainer via hollow spaces connected to the hollow shaft body and disposed in each milling cup retainer, and wherein a first eccentric shaft of the separate eccentric shafts is connected to a cooling medium inlet and a second eccentric shaft of the separate eccentric shafts is connected to a cooling medium outlet.

7. The ball mill of claim 6, wherein a hollow space is disposed in a lower part of each milling cup retainer in a connecting area surrounding ends of the separate eccentric shafts as well as in the central area forming a support for the clamped milling cup through which a cooling medium is conducted.

8. The ball mill of claim 7, wherein at least one hollow space is disposed in an upper part of each milling cup retainer, wherein the upper part overlaps the clamped milling cup at a central part of the upper part resting on the clamped milling cup, and wherein the at least one hollow space is connected to the hollow spaces of connecting areas of the lower part through which said cooling medium is to be conducted.

9. The ball mill of claim 1, wherein the counterweight can be re-adjusted according to a mass of the milling cup retainer and the milling cup clamped therein.

10. The ball mill of claim 1, wherein the milling cup ends of the milling cup are flat.

11. The ball mill of claim 1, wherein the milling cup ends of the milling cup are dome-shaped.

12. The ball mill of claim 1, wherein the separate eccentric shafts connected to each milling cup retainer are driven by a common drive element and wherein a compensation clearance is set on one of the separate eccentric shafts between the one of the separate eccentric shafts and the common drive element.

13. The ball mill of claim 12, wherein a toothed washer is disposed on an end of each of the separate eccentric shafts opposite the connected milling cup retainers, wherein the common drive element is a revolving toothed belt engaging with teeth of the toothed washer, and wherein a width of tooth spaces between the teeth of the toothed washer is greater than a width of teeth on the toothed belt.

14. The ball mill of claim 13, wherein all of the separate eccentric shafts of the milling cup retainers arranged on the machine base plate are driven by the common drive element and wherein the compensating clearance is set on only one of the separate eccentric shafts connected to a single milling cup retainer.

15. The ball mill of claim 1, wherein the first rotational path of the first milling cup retainer causes the first milling cup retainer to rotate in a first rotational direction, and wherein the second rotational path of the second milling cup retainer causes the second milling cup retainer to rotate in the first rotational direction.

* * * * *